US006942109B2

(12) United States Patent
Aros et al.

(10) Patent No.: US 6,942,109 B2
(45) Date of Patent: Sep. 13, 2005

(54) ROTARY DISPLAY APPARATUS FOR DISPLAYING PERIODICALS IN A CIRCULAR ARRAY

(76) Inventors: Carlos Joaquin Aros, 14001 Garfield Ave., Paramount, CA (US) 90723; Sylvan S. Throndson Aros, 14001 Garfield Ave., Paramount, CA (US) 90723; Eliseo Salcedo, 4052 Cudahy St., Huntington Park, CA (US) 90255

( * ) Notice: Subject to any disclaimer, the term of this patent is extended or adjusted under 35 U.S.C. 154(b) by 0 days.

(21) Appl. No.: 10/643,558

(22) Filed: Aug. 18, 2003

(65) Prior Publication Data

US 2005/0040121 A1 Feb. 24, 2005

(51) Int. Cl.[7] ..... A47F 5/00

(52) U.S. Cl. ..... 211/58; 211/163; 211/131.1; 211/45

(58) Field of Search ..... 211/70, 58, 163, 211/131.1, 50, 45

(56) References Cited

U.S. PATENT DOCUMENTS

| | | | | | |
|---|---|---|---|---|---|
| 226,645 | A | * | 4/1880 | Albaugh | 211/129.1 |
| 256,600 | A | | 4/1882 | Schell | |
| 1,755,029 | A | | 4/1930 | Schreiber | |
| 1,930,844 | A | | 10/1933 | Ruddell | |
| 2,614,698 | A | * | 10/1952 | Bell | 211/62 |
| 3,003,648 | A | | 10/1961 | La Vigne | |
| 3,170,741 | A | | 2/1965 | Richards, Jr. | |
| 3,341,266 | A | | 9/1967 | Schecter et al. | |
| 3,844,230 | A | | 10/1974 | Hudson et al. | |
| 3,887,077 | A | * | 6/1975 | Frey | 211/45 |
| 3,998,334 | A | | 12/1976 | Smith | |
| 4,305,511 | A | * | 12/1981 | Denholtz | 211/70 |
| D270,024 | S | | 8/1983 | Strasser | |
| 4,424,904 | A | | 1/1984 | Applegate, Jr. | |
| 4,426,010 | A | | 1/1984 | Le Mer | |
| 4,438,853 | A | | 3/1984 | Numbers | |
| 4,519,510 | A | * | 5/1985 | Learnard | 211/131.1 |
| D279,950 | S | * | 8/1985 | Wan | D7/640 |
| 4,534,474 | A | * | 8/1985 | Ng | 211/70 |
| 4,548,324 | A | | 10/1985 | Mackey, Jr. | |
| 4,609,112 | A | * | 9/1986 | Belanger et al. | 211/45 |
| 4,938,549 | A | | 7/1990 | Potter | |
| 5,253,594 | A | | 10/1993 | Sideris | |
| 5,547,085 | A | | 8/1996 | Gaus | |
| 5,772,055 | A | | 6/1998 | Orr et al. | |
| D428,624 | S | * | 7/2000 | Kwok | D19/77 |
| 2001/0000286 | A1 | | 4/2001 | Lewis et al. | |
| 2004/0000527 | A1 | * | 1/2004 | Repisky | 211/50 |

* cited by examiner

*Primary Examiner*—Robert W. Gibson, Jr.
(74) *Attorney, Agent, or Firm*—Louis J. Bovasso, Esq.; Greenberg Traurig, LLP

(57) ABSTRACT

A rotary display apparatus is provided having a plurality of concentric circular areas in which a plurality of concentric circular areas in which a plurality of differing magazines and other printed materials can be displayed in a circular array presenting the covers of the same to full view.

11 Claims, 2 Drawing Sheets

ROTARY DISPLAY APPARATUS FOR DISPLAYING PERIODICALS IN A CIRCULAR ARRAY

BACKGROUND OF THE INVENTION

1. Field of the Invention

The invention relates to display apparatus; and, more particularly, to a rotary display for displaying a plurality of different periodicals or the like in a circular array.

2. Related Art

Many display devices are well known in the art. Some of these, such as the revolving bookcase in U.S. Pat. No. 256,600 to Schell, rotate to display books but cannot be used to display magazines wherein the covers of differing ones of the same can be displayed simultaneously. Other patents are similarly deficient. For example, in U.S. Pat. No. 4,426,010 to Le Mer, there is disclosed a filing drum but magazines cannot be displayed in a circular array. In U.S. Pat. No. 3,998,334 to Smith, a merchandise display rack is shown but the flat circular discs would prevent display of magazines in a circular array. In U.S. Pat. No. 4,438,853, there is disclosed a storage rack for baby food containers but magazines could not be displayed in a circular array.

Many other prior art devices for displaying magazines or the like include bulky vertical racks wherein the covers of the magazines being displayed may not be visible.

Other prior art patents are similarly deficient. There is a need for a rotary display rack that can present the covers of a plurality of differing periodicals, such as magazines, in a circular array so that a viewer can see what magazine he or she would like to read and pick it out of the display.

SUMMARY OF THE INVENTION

It is an object of this invention to provide a rotary display for displaying periodicals, such as magazines, in a circular array.

It is still further an object of this invention to provide such a display having concentric circular areas for displaying a plurality of such periodicals.

It is a further object of this invention to provide such a display made of transparent plastic or open wire framework or a combination of both, for viewing the interior of the display.

These and other objects are preferably accomplished by providing a rotary display apparatus having a plurality of concentric circular areas in which a plurality of different magazines and other printed materials can be displayed in a circular array presenting the covers of the same to full view.

DESCRIPTION OF THE PREFERRED EMBODIMENTS

Figure 1:
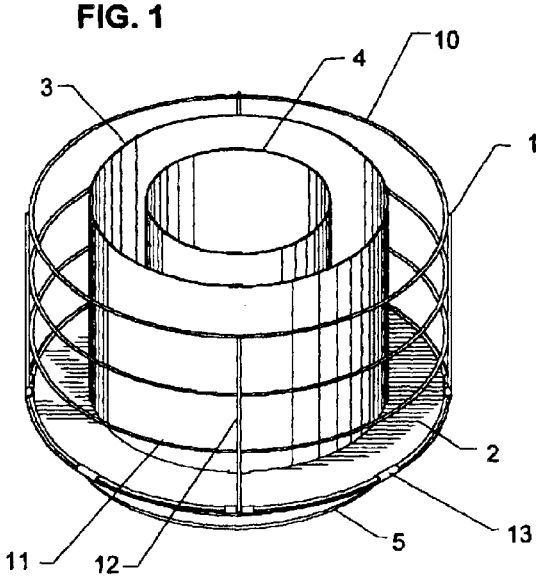
FIG. 1 is a perspective view of a display apparatus in accordance with the teachings of the invention.
Figure 3:
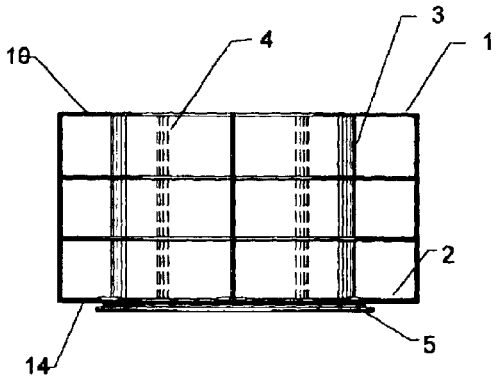
FIG. 3 is an elevational view of the apparatus of FIGS. 1 and 2.

Referring now to FIG. 1 of the drawing, a display apparatus 1 is shown comprised of a plurality, such as 3, of concentric cylindrical sections 10, 3 and 4. Section 10 is the largest diameter outer section and may be comprised of a wire framework formed by circular wire elements 11 interconnected by spaced vertical wire elements 12. The lowermost circular wire element 11 is connected, in any suitable manner, such as connectors 13, to a generally flat planar circular base 2. As seen in FIG. 3, the underside 14 of base 2 is coupled to a rotary device, such as a rotatable turntable 5 or glides or the like.

Referring again to FIG. 1, second cylindrical section 3, of lesser diameter than section 10, is spaced from section 10 and may be of opaque material of like and also secured to base 2 in any suitable manner. A third cylindrical section 4, of lesser diameter than section 3, is spaced from section 3 and may also be of opaque material. It is also secured to base 2 in any suitable manner.

Figure 2:
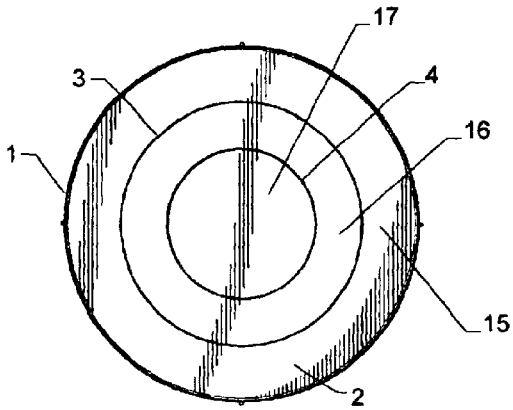
FIG. 2 is a top plan view of the apparatus of FIG. 1.

As seen in FIG. 2, a plurality of circular concentric areas 15 to 17 are thus provided about apparatus 10. As seen in FIG. 3, the sections 10, 3 and 4 are preferably of the same overall height so as to present a visually appealing appearance. However, the sections 10, 3 and 4 may be of differing heights if desired.

Figure 4:
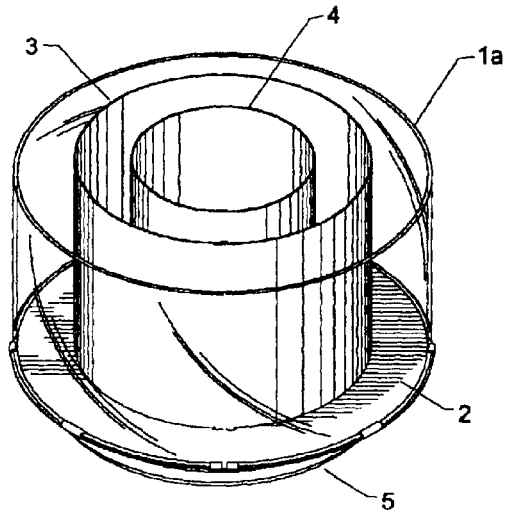
FIG. 4 is a perspective view of a second embodiment of the apparatus of FIGS. 1 to 3.

As seen in FIG. 4, a modification of the outer wall or section 10 of FIG. 1 is shown. Thus, outer section 1*a* may be of a transparent plastic instead of being formed by a plurality of interconnected wire elements as in the embodiment of FIG. 1.

If desired, a display card or the like may be provided on the apparatus of FIGS. 1 and 4. This can be seen in FIG. 5 wherein like numerals refer to like parts of FIG. 1 In this embodiment, a socket 6 is secured at generally the midpoint of base 2 and a pole 7 extends upwardly therefrom. A display card 8 may be secured to the top of pole 7 to provide indicia associated with the apparatus (or may be provided with hooks or holes to insert fasteners to display cards, packages, etc.).

Figure 6:
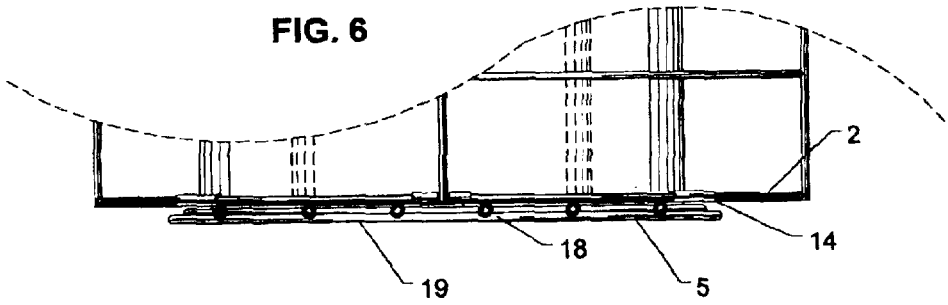
FIG. 6 is a detailed view of the rotatable turntable alone of the invention.

Any suitable means may be used to rotate the apparatuses of FIGS. 1 to 4. Rotatable turntable 5 is shown in detail in FIG. 6. Thus, turntable 5 may include a circular ball bearing plate 18 mounted to the underside 14 of base 2 and secured to a base support 19. Plate 18 is well known in the art and allows base 2 to rotate with respect to base support 19.

Figure 5:
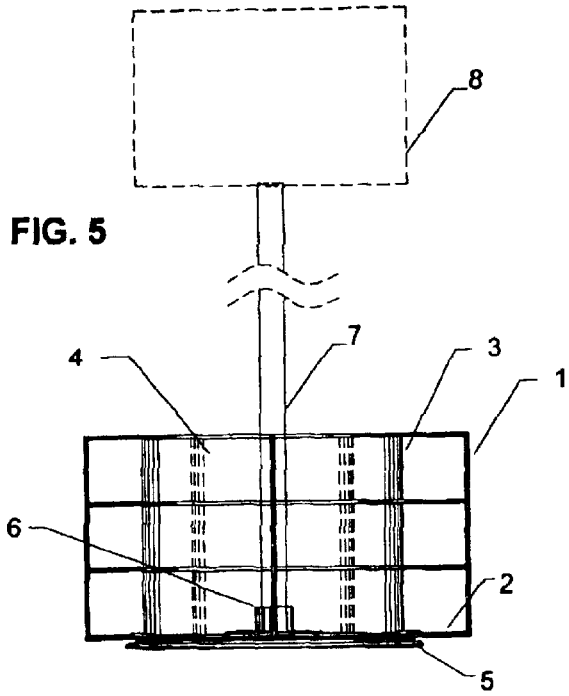
FIG. 5 is an elevational view of a third embodiment of the apparatus of FIGS. 1 to 3.
Figure 7:
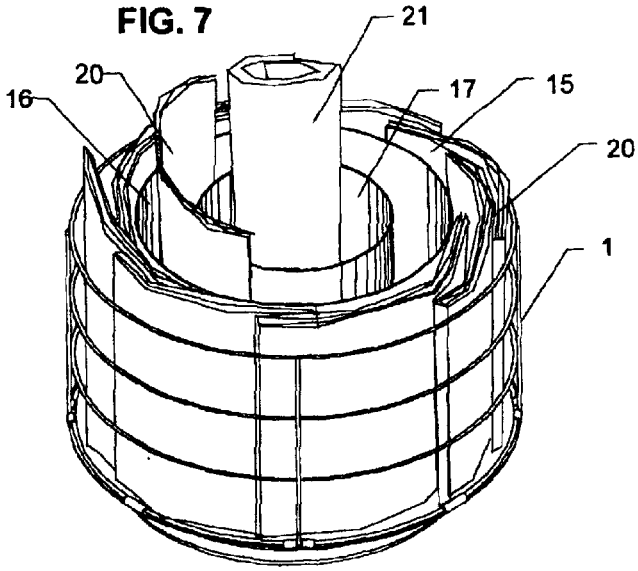
FIG. 7 is a perspective view of the apparatus of FIG. 1 showing a plurality of periodicals displayed therein.

The apparatus 1 of FIG. 1 is shown in FIG. 7 having a plurality of magazines and periodicals displayed therein. It is of course understood that the apparatus of FIGS. 4 and 5 are used in like manner.

In any event, it can be seen in FIG. 7 that a plurality of magazines 20 are displayed in a circular array within area 15 (FIG. 2) and a plurality of other magazines which may be taller, or newspapers 21 (FIG. 7), are displayed in center area 17 (FIG. 2). Other magazines 20 (FIG. 7) are displayed in a circular array within area 16 (FIG. 2).

It can be seen that there are disclosed multiple storage areas in a single apparatus for regularly sized magazines, taller magazines or newspapers, or other publications. The newspapers, magazines and other periodicals are organized neatly without sacrificing valuable space. The apparatuses of the invention can be used in a child's room, a living room, beauty parlors, barbershops, a doctor's office, etc. The titles and articles in magazines 20 are prominently displayed in a circular array. Colorful comic books and coloring books can be displayed in a like manner in a child's room, nursery, pediatric office, etc.

Although three areas 15 to 17 are disclosed, obviously two may be provided (area 16 may be eliminated). The wall 3 supports the backs of the magazines so they stand up. Although a wire framework is disclosed in FIG. 1, and a transparent outer wall in FIG. 4, obviously any suitable see-through means may be used, such as a perforated screen, wire mesh, etc. The middle cylinder 4 may be eliminated and if used, can hold other materials.

A plurality of devices, such as apparatus 1 in FIG. 1, may be stacked and vertically interconnected in any suitable manner. Any suitable materials may be used, such as plastic, metal, etc. The apparatuses of the invention may be of any suitable dimensions, such as 15½" in overall diameter and 8½" in overall height.

Although a particular embodiment of the invention has been disclosed, variations thereof may occur to an artisan and the scope of the invention is only intended to be limited by the scope of the appended claims.

What is claimed is:

1. A display apparatus for displaying a plurality of magazines or the like in a circular array comprising:

a) a rotatable base; and b) a plurality of generally circular display areas mounted on said base, said areas including a first outer area on said base defined by an upper generally cylindrical outer wall having an inner wall portion and an outside portion mounted to said base and extending upwardly therefrom, at least a second area on said base inwardly of said outer area defined by an upper generally first cylindrical inner wall having an outer wall portion mounted to said base and extending upwardly therefrom, said first inner wall being visible from the outside portion of said outer wall, said second area being further defined by a second cylindrical inner wall spaced from said first cylindrical inner wall, each of said first and second areas forming a pair of spaced toroidally shaped obstruction-free compartments whereby a plurality of magazines may be disposed at any location within said first outer area resting on said base and extending upwardly therefrom with the front covers thereof disposed against the inner wall portion of said outer wall in a generally circular contiguous array about said first outer area and the back covers thereof abutting against the outer wall portion of said inner wall, and a plurality of magazines may be disposed at any location within said second area.

2. The apparatus of claim 1 including a generally cylindrical wall generally centrally mounted on said base within said inner wall.

3. The apparatus of claim 2 wherein said inner wall is of a translucent material.

4. The apparatus of claim 1 wherein said inner wall is of a translucent material.

5. The apparatus of claim 1 wherein said outer wall is an open wire framework.

6. The apparatus of claim 1 wherein said outer wall is of transparent plastic.

7. The apparatus of claim 1 wherein said inner and outer walls are of the same overall height.

8. The apparatus of claim 1 wherein said inner and outer walls are of differing heights.

9. The apparatus of claim 1 wherein said rotatable base includes a fixed lower base portion, and ball bearing means coupled to both said base and said base portion for rotating said base with respect to said base portion.

10. The apparatus of claim 1 including a display pole generally centrally mounted on said base extending generally vertically upwardly therefrom, said pole having a display card fixedly secured to the upper end thereof.

11. A display apparatus for displaying a plurality of magazines or the like in a circular array comprising:

a) a rotatable base; and b) a plurality of generally circular display areas mounted on said base, said areas including a first outer area on said base defined by an upper generally cylindrical outer wall having an inner wall portion and an outside portion mounted to said base and extending upwardly therefrom, at least a second area on said base inwardly of said outer area defined by an upper generally cylindrical inner wall having an outer wall portion mounted to said base and extending upwardly therefrom, said inner wall being visible from the outside portion of said outer wall, whereby a plurality of magazines may be disposed within said first outer area resting on said base and extending upwardly therefrom with the front covers thereof disposed against the inner wall portion of said outer wall in a generally circular array about said first outer area and the back covers thereof abutting against the outer wall portion of said inner wall, and a display pole generally centrally mounted on said base extending generally vertically upwardly therefrom, said pole having a display card fixedly secured to the upper end thereof.

* * * * *